US009008567B2

(12) United States Patent
Satoh et al.

(10) Patent No.: US 9,008,567 B2
(45) Date of Patent: Apr. 14, 2015

(54) IMAGE FORMING APPARATUS WITH GUIDE MEMBER SHAPED TO CLEAR RECORDING MEDIUM

(71) Applicant: Fuji Xerox Co., Ltd., Tokyo (JP)

(72) Inventors: Ryuichi Satoh, Kanagawa (JP); Hirokatsu Sugawara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 171 days.

(21) Appl. No.: 13/752,977

(22) Filed: Jan. 29, 2013

(65) Prior Publication Data

US 2014/0010580 A1 Jan. 9, 2014

(30) Foreign Application Priority Data

Jul. 5, 2012 (JP) ..... 2012-151801

(51) Int. Cl.
*G03G 15/20* (2006.01)
*B65H 29/24* (2006.01)
*G03G 15/00* (2006.01)

(52) U.S. Cl.
CPC ..... *G03G 15/2028* (2013.01); *G03G 15/2085* (2013.01); *B65H 29/242* (2013.01); *G03G 15/657* (2013.01)

(58) Field of Classification Search
CPC ..... B65H 29/242; G03G 15/2028; G03G 15/657; G03G 15/2085; G03G 2215/00413
USPC ..... 399/400, 122, 320, 322
See application file for complete search history.

(56) References Cited

U.S. PATENT DOCUMENTS

| | | | | |
|---|---|---|---|---|
| 4,843,214 | A * | 6/1989 | Higashi et al. | 219/216 |
| 6,169,874 | B1 * | 1/2001 | Quesnel et al. | 399/400 |
| 7,079,804 | B2 * | 7/2006 | Ando et al. | 399/400 |
| 2009/0297242 | A1 * | 12/2009 | Kanematsu | 399/400 |

FOREIGN PATENT DOCUMENTS

JP 04-322280 A 11/1992

* cited by examiner

*Primary Examiner* — Judy Nguyen
*Assistant Examiner* — Blake A Tankersley
(74) *Attorney, Agent, or Firm* — Sughrue Mion, PLLC

(57) ABSTRACT

An image forming apparatus includes a transfer member that transfers a toner image to a surface of a recording medium, a transport member that transports the recording medium, with the surface of the recording medium on which the toner image has been transferred by the transfer member facing down, a fixing member that fixes the toner image onto the recording medium while nipping and transporting the recording medium, and a guide member that contacts a back side of the recording medium to guide the recording medium toward the fixing member, the guide member having a clearance part, the clearance part being formed in a portion that guides an outer side portion of a width direction of the recording medium, the clearance part being so shaped as to be clear of the back side of the recording medium.

12 Claims, 12 Drawing Sheets

IMAGE FORMING APPARATUS WITH GUIDE MEMBER SHAPED TO CLEAR RECORDING MEDIUM

CROSS-REFERENCE TO RELATED APPLICATIONS

This application is based on and claims priority under 35 USC 119 from Japanese Patent Application No. 2012-151801 filed Jul. 5, 2012.

BACKGROUND

Technical Field

The present invention relates to an image forming apparatus.

SUMMARY

According to an aspect of the invention, there is provided an image forming apparatus including a transfer member that transfers a toner image to a surface of a recording medium, a transport member that transports the recording medium, with the surface of the recording medium on which the toner image has been transferred by the transfer member facing down, a fixing member that is placed on a downstream side of a transport direction of the recording medium with respect to the transport member, the fixing member fixing the toner image onto the recording medium while nipping and transporting the recording medium, and a guide member that is placed between the transport member and the fixing member, the guide member contacting a back side of the recording medium to guide the recording medium toward the fixing member, the guide member having a clearance part, the clearance part being formed in a portion that guides an outer side portion of a width direction of the recording medium, the clearance part being so shaped as to be clear of the back side of the recording medium.

BRIEF DESCRIPTION OF THE DRAWINGS

Exemplary embodiments of the present invention will be described in detail based on the following figures, wherein.

DETAILED DESCRIPTION

First Exemplary Embodiment

An example of an image forming apparatus according to a first exemplary embodiment of the invention will be described with reference to FIGS. 1 to 9B. An arrow UP in the figures indicates vertically upward direction.

(Overall Configuration)

Figure 8:
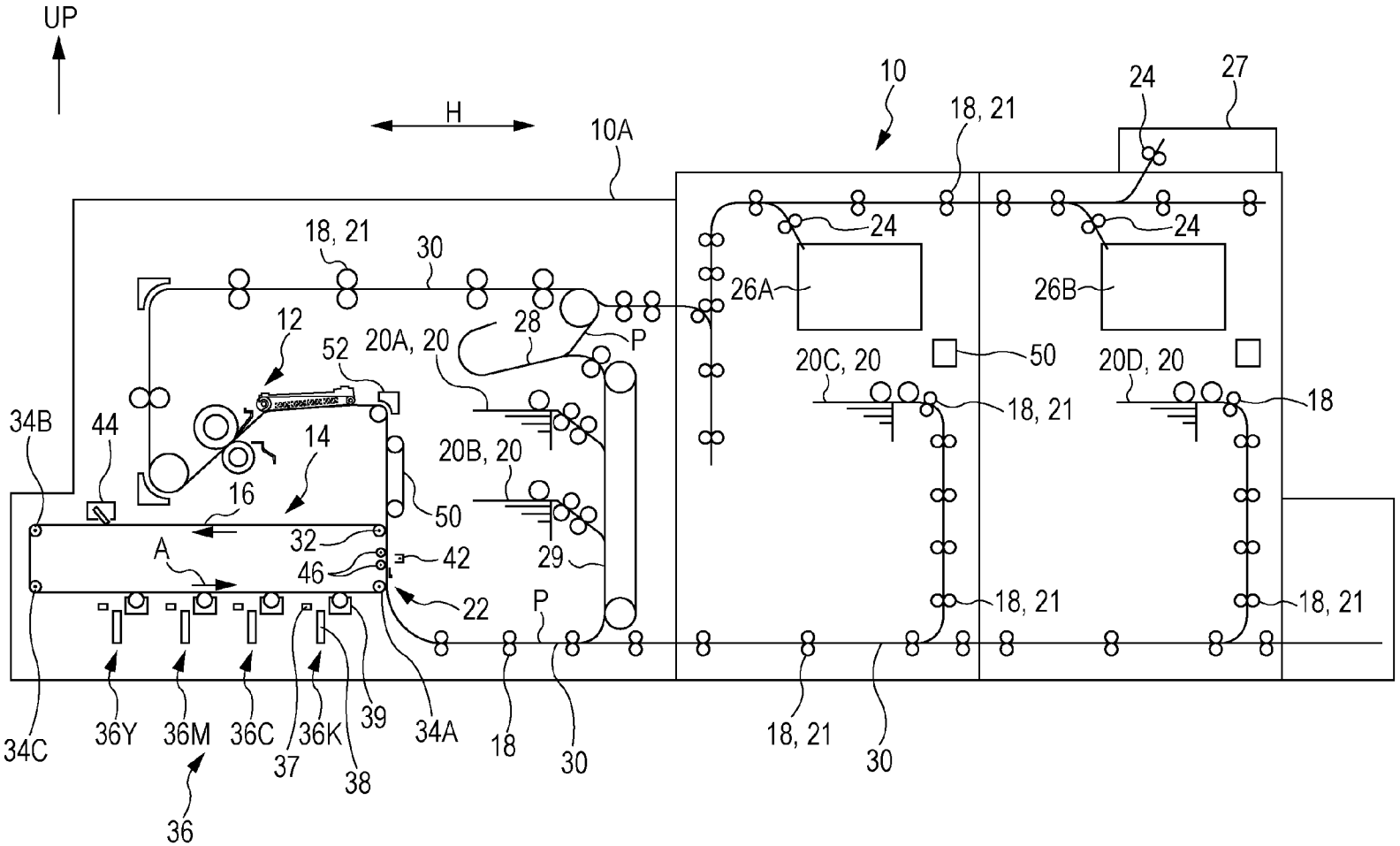
FIG. 8 is a schematic diagram illustrating the image forming apparatus according to the first exemplary embodiment of the invention.

As illustrated in FIG. 8, inside an apparatus body 10A of an image forming apparatus 10, there are provided a paper feed section 20, an image forming section 14, a transfer section 22, a fixing section 12, and a sheet transport system 21. A sheet member P as a recording medium is placed on the paper feed section 20. The image forming section 14 forms a toner image that is to be transferred to the sheet member P. The transfer section 22 transfers the toner image to the sheet member P. The fixing section 12 fixes the toner image onto the sheet member P. The sheet transport system 21 includes multiple transport rollers 18 that transport the sheet member P along a transport path 30 of the sheet member P.

The image forming section 14, the transfer section 22, and the fixing section 12 are placed on the left side in FIG. 8 of the horizontal direction (left-right direction: arrow H direction in FIG. 8) in the apparatus body 10A. The paper feed section 20 is placed from the center side of the horizontal direction to the right side in FIG. 8 in the apparatus body 10A.

[Paper Feed Section]

The paper feed section 20 includes a paper feed member 20A, a paper feed member 20B, a paper feed member 20C, and a paper feed member 20D on which the sheet member P is placed.

The paper feed member 20A and the paper feed member 20B are placed in a vertically aligned manner, on the center side of the horizontal direction (arrow H direction in FIG. 8) in the apparatus body 10A.

The paper feed member 20C and the paper feed member 20D are placed in a horizontally aligned manner, on the right side in FIG. 8 with respect to the paper feed member 20A and the paper feed member 20B.

[Image Forming Section]

The image forming section 14 is placed on the side opposite to the paper feed member 20C across the paper feed member 20B. The image forming section 14 includes an endless image carrier belt 16, a driving roller 32 around which the image carrier belt 16 is wound and which transmits a rotary force to the image carrier belt 16, and multiple driven rollers 34 around which the image carrier belt 16 is wound.

Further, the driven rollers 34 include a driven roller 34A, a driven roller 34B, and a driven roller 34C. The driven roller 34A is placed vertically below the driving roller 32. The driven roller 34B is placed in a horizontally aligned manner with respect to the driving roller 32. The driven roller 34C is placed vertically below the driven roller 34B and in a horizontally aligned manner with respect to the driven roller 34A.

The image carrier belt 16 is placed so as to extend horizontally while being wound around the driving roller 32 and the driven rollers 34. A pair of driven rollers 46 are placed so as to support the back side (side on which an image is not formed) of the image carrier belt 16 that revolves between the driving roller 32 and the driven roller 34A.

Further, the image forming section 14 includes an image forming unit 36 that forms a toner image on the surface of the image carrier belt 16.

The image forming unit 36 is placed below the image carrier belt 16. The image forming unit 36 includes image forming units 36Y, 36M, 36C, and 36K for various colors that form toner images of the colors yellow (Y), magenta (M), cyan (C), and black (K), respectively, on the surface of the image carrier belt 16.

The image forming units 36Y, 36M, 36C, and 36K are placed in this order in a horizontally aligned manner along the direction of revolution of the image carrier belt 16 (arrow A direction in FIG. 8: hereinafter simply referred to as "belt revolution direction") so as to face the surface of the image carrier belt 16. In the following description, indication of Y, M, C, and K will be omitted in cases where no distinction is to be made between Y, M, C, and K.

The image forming unit 36 used for each color includes a charging unit 37, an exposure head 38, and a developing unit 39 that are placed in this order in the belt revolution direction.

Specifically, the charging unit 37 is a charge corontron, and charges the surface of the image carrier belt 16 uniformly. The exposure head 38 is an LED array or raster optical scanner, and exposes the charged surface of the image carrier belt 16 to light to thereby form an electrostatic latent image on the image carrier belt 16.

The developing unit 39 receives developer in the inside, and renders the electrostatic latent image formed on the image carrier belt 16 visible as a toner image, by using toner contained in this developer.

[Transfer Section]

The transfer section 22 transfers the toner image formed on the image carrier belt 16 to the sheet member P. The transfer section 22 is placed on the downstream side of the belt revolution direction with respect to the image forming unit 36, so as to face the surface of the image carrier belt 16 revolving between the driving roller 32 and the driven roller 34A.

The transfer section 22 includes a transfer corontron 42. The transfer corontron 42 is an example of a transfer member that is placed so as to face the surface of the image carrier belt 16 revolving between the driving roller 32 and the driven roller 34A, and extends in the width direction (depth direction in the plane of FIG. 8) of the image carrier belt 16.

Figure 7:
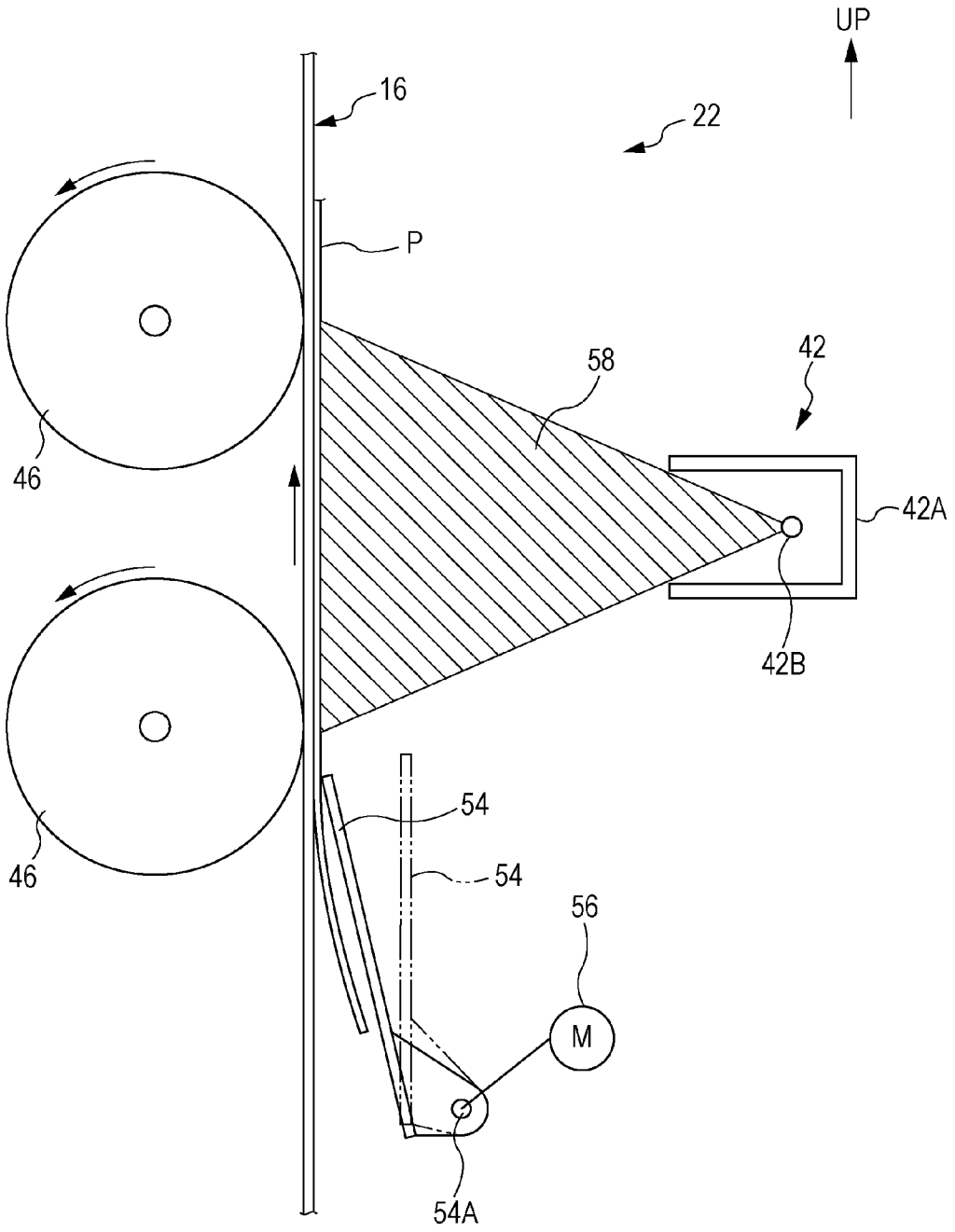
FIG. 7 is a side view illustrating a transfer section provided to the image forming apparatus according to the first exemplary embodiment of the invention.

As illustrated in FIG. 7, the transfer corontron 42 includes a housing 42A with a U-shaped cross-section whose image carrier belt 16 side is open, and a discharge wire 42B that is placed inside the housing 42A.

A transfer blade 54 is placed on the upstream side of the belt revolution direction with respect to the transfer corontron 42. The transfer blade 54 nips the sheet member P being transported with the image carrier belt 16.

The transfer blade 54 is formed in a substantially plate-like shape molded from a resin material. The transfer blade 54 is supported so as to be rotatable about a rotating shaft 54A that extends in the width direction of the image carrier belt 16.

Further, a stepping motor 56 is provided. The stepping motor 56 rotationally moves the rotating shaft 54 to thereby move the transfer blade 54 between a nip position (solid line in FIG. 7) in which the transfer blade 54 nips the sheet member P with the image carrier belt 16, and a separated position (two-dot chain line in FIG. 7) in which the transfer blade 54 is separated from the image carrier belt 16.

According to the above-mentioned configuration, the leading edge of the sheet member P being transported enters a discharge area 58 due to the transfer corontron 42, and the leading edge of the sheet member P is electrostatically attracted to the image carrier belt 16. After the leading edge of the sheet member P is electrostatically attracted to the image carrier belt 16, the stepping motor 56 rotationally moves the rotating shaft 54A to thereby move the transfer blade 54 from the separated position to the nip position. Then, the transfer corontron 42 transfers the toner image formed on the image carrier belt 16 to the sheet member P that is being transported while overlapping the surface of the image carrier belt 16. Then, before the trailing edge of the sheet member P leaves the tip of the transfer blade 54, the stepping motor 56 rotationally moves the rotating shaft 54A to thereby move the transfer blade 54 from the nip position to the separated position.

A cleaning mechanism 44 (see FIG. 8) is provided on the downstream side of the belt revolution direction with respect to the transfer section 22. The cleaning mechanism 44 removes untransferred residual toner remaining on the image carrier belt 16 from the image carrier belt 16.

[Others]

As illustrated in FIG. 8, a belt transport device 50 is placed on the downstream side of the sheet transport direction with respect to the transfer section 22. The belt transport device 50 is a vacuum transport that transports the sheet member P with the transferred toner image upwards. Further, a guide member 52 is placed on the downstream side of the sheet transport direction with respect to the belt transfer device 50. The guide member 52 guides the sheet member P toward the fixing section 12, with the surface of the sheet member P on which the toner image has been transferred facing down. The fixing section 12 will be described later in detail.

On the downstream side of the sheet transport direction with respect to the fixing section 12, a stacker 26A and a stacker 26B, and a purge tray 27 are placed so as to extend vertically. The sheet member P with a fixed toner image is ejected to the stacker 26A and the stacker 26B by an eject roller 24. The sheet member P that has become unnecessary owing to some problem occurring during its transport is ejected to the purge tray 27.

The stacker 26A is placed above the paper feed member 20C. The stacker 26B is placed above the paper feed member 20D. Further, the purge tray 27 is placed above the stacker 26B.

A reverse transport path 28 is provided between the fixing section 12 and the stacker 26A in the transport path 30. The sheet member P is sent to the reverse transport path 28 in a case where an image is to be formed on the front and back of the sheet member P.

Further, a transport belt 29 is provided below the reverse transport path 28. The transport belt 29 transports the sheet member P sent out from the reverse transport path 28, toward the transport path 30. The sheet member P sent out from each of the paper feed member 20A and the paper feed member 20B is also transported toward the transport path 30 by the transport belt 29.

According to the above-mentioned configuration, the sheet member P is sent to the reverse transport path 28, and as the sheet member P is switched back and sent out from the reverse transport path 28 toward the transport belt 29, the front and back of the sheet member P are reversed.

(Operation of Overall Configuration)

Next, an image forming operation by the image forming apparatus 10 will be described.

First, a toner image is formed on the image carrier belt 16 by the image forming unit 36 used for each color. Meanwhile, the sheet member P sent out from the paper feed section 20 and transported along the transport path 30 by the multiple transport rollers 18 is transported to the transfer section 22.

In the transfer section 22, the sheet member P is transported so as to overlap the surface of the image carrier belt 16 by the transfer blade 54 (see FIG. 7), and the toner image on the image carrier belt 16 is transferred to the sheet member P by the transfer corontron 42.

Then, the sheet member P with the transferred toner image is transported to the fixing section 12 by the belt transport device 50 and the guide member 52, and the toner image is fixed onto the sheet member P by the fixing section 12. Further, the sheet member P with the fixed toner image is ejected to the stacker 26 by the transport rollers 18 and the eject roller 24.

In the case of forming an image on both sides (front side and back side) of the sheet member P, the sheet member P with the toner image fixed on the front side is sent to the reverse transport path 28 where the sheet member P is switched back, and then sent out toward the transfer belt 29. As a result, the sheet member P whose front and back have been reversed is transported to the transfer section 22 again by the transport belt 29 and the transport rollers 18, where the toner image is transferred to the back side of the sheet member P by the same procedure as that described above. Then, as the sheet member P passes through the fixing section 12, the toner image is fixed onto the back side of the sheet member P, and then the sheet member P is ejected to the stacker 26A or the stacker 26B by the eject roller 24.

(Configuration of Major Part)

Next, the fixing section 12 and the like will be described.

The fixing section 12 includes a belt transport device 60. The belt transport device 60 is an example of a transport member that is placed on the downstream side of the sheet transport direction with respect to the guide member 52, and transports the sheet member P, with the surface of the sheet member P on which a toner image has been transferred facing down (see FIGS. 1 and 6).

Figure 1:
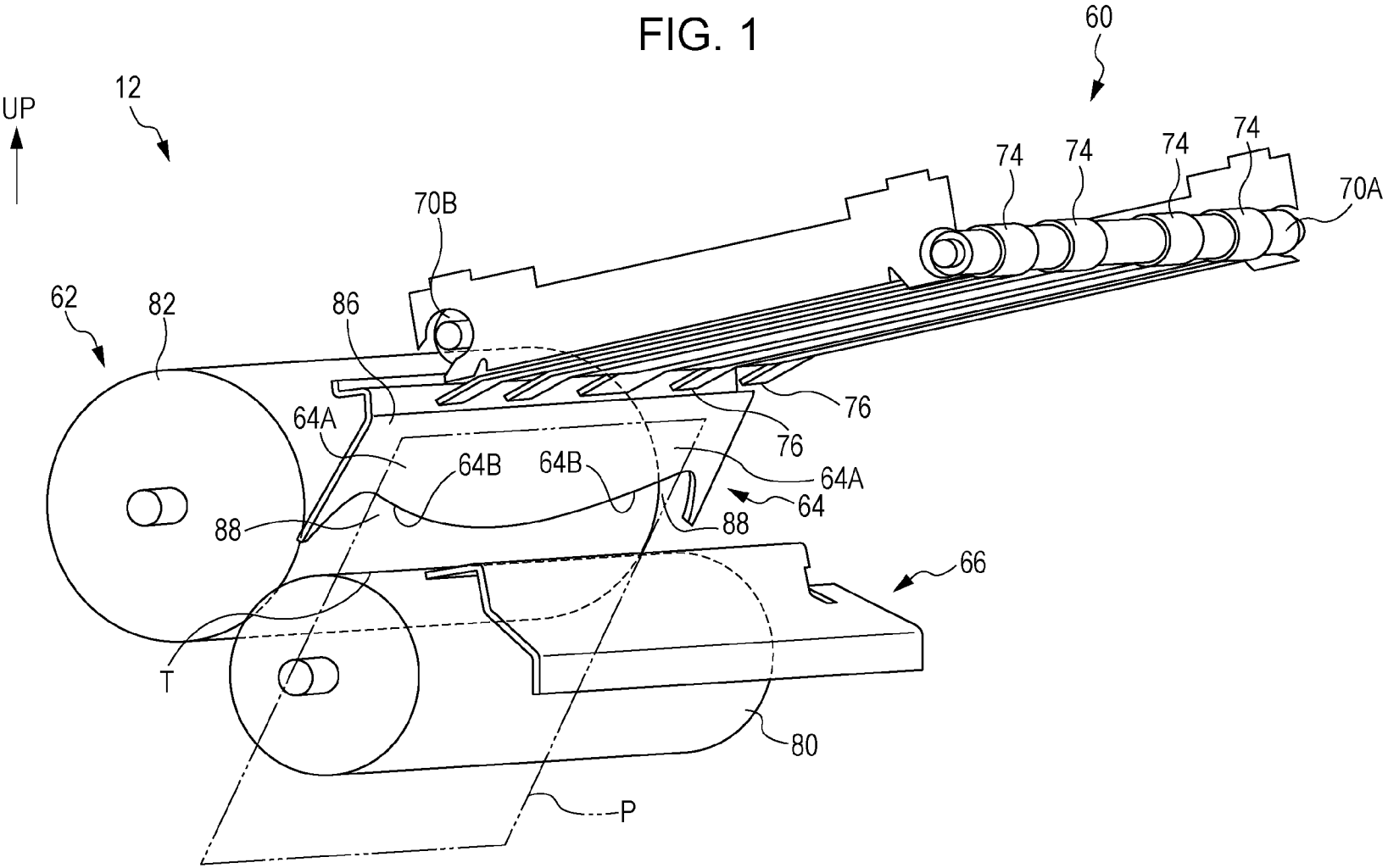
FIG. 1 is a perspective view illustrating a fixing section provided to an image forming apparatus according to a first exemplary embodiment of the invention.
Figure 6:
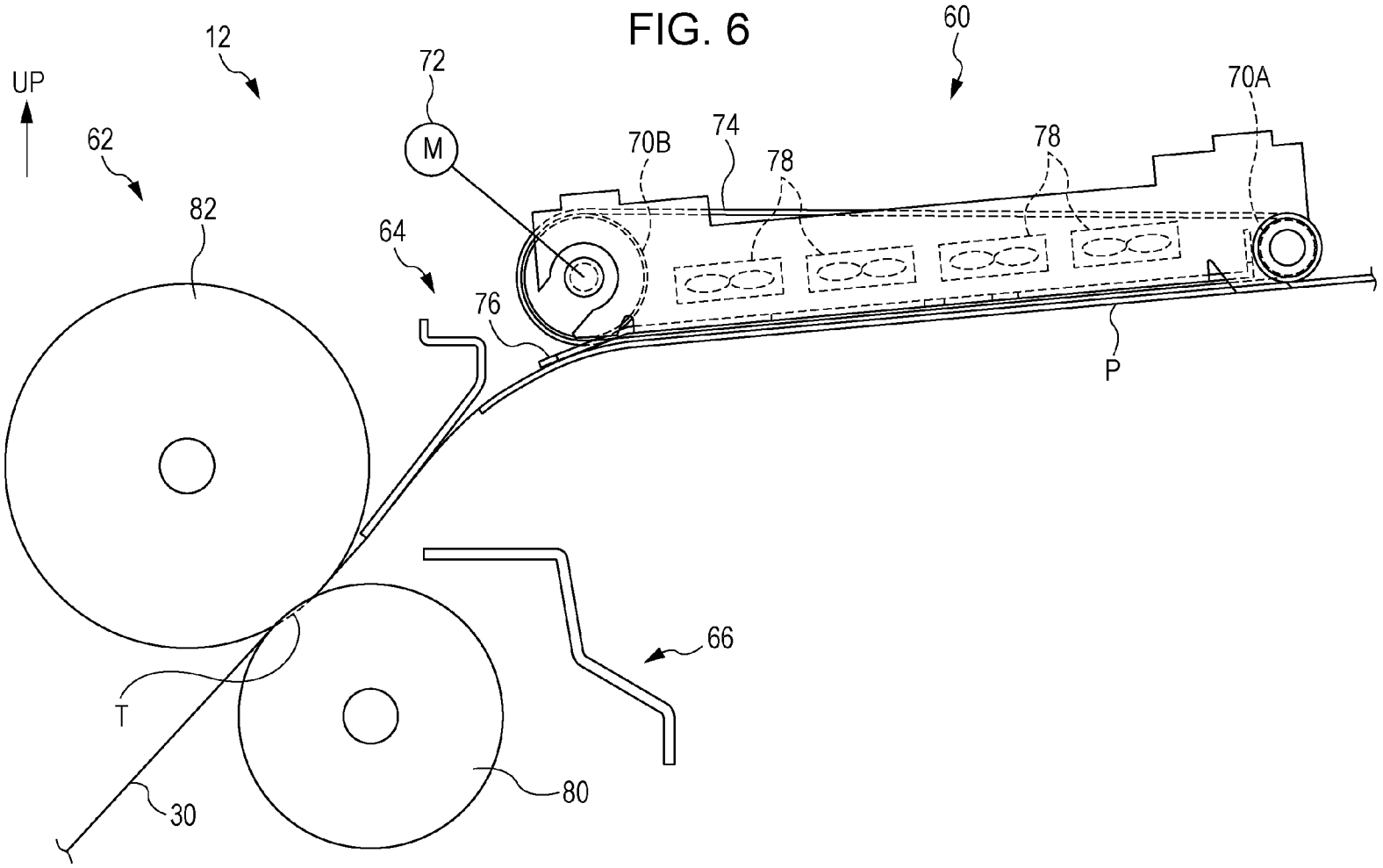
FIG. 6 is a side view illustrating the fixing section provided to the image forming apparatus according to the first exemplary embodiment of the invention.

Further, as illustrated in FIGS. 1 and 6, the fixing section 12 includes a fixing device 62. The fixing device 62 is an example of a fixing member that is placed on the downstream side of the sheet transport direction with respect to the belt transport device 60, and fixes the toner image onto the sheet member P.

A guide plate 64 is placed between the belt transport device 60 and the fixing device 62 in the transport path 30. The guide plate 64 is an example of a guide member that contacts the back side of the sheet member P to guide the sheet member P toward the fixing device 60. Further, a protection member 66 is placed on the side opposite to the guide plate 64 across the transport path 30 so as to extend in a direction orthogonal to the sheet transport direction (hereinafter, simply referred to as "direction orthogonal to transport"). The protection member 66 protects a heat roller 80 described later that is provided to the fixing device 62.

As described above, the fixing section 12 includes the belt transport device 60, the fixing device 62, the guide plate 64, and the protection member 66.

[Transport Device]

The belt transport device 60 is a vacuum transport, and is a device that transports the sheet member P to the downstream side of the sheet transport direction while attracting the sheet member P from the back side.

The belt transport device 60 includes a roller 70A, a roller 70B, and multiple endless belts 74. The roller 70A is rotatably supported in place. The roller 70B is placed on the downstream side of the sheet transport direction with respect to the roller 70A, and a rotary force from a motor 72 is transmitted to the roller 70B. The endless belts 74 are wound around the rollers 70A and 70B.

The endless belts 74 have multiple through-holes (not illustrated) that extend through the front and back of the endless belts 74. The endless belts 74 are spaced apart from each other in the direction orthogonal to transport.

Further, multiple guiding plates 76 are placed between adjacent endless belts 74. The distal end side (downstream side of the sheet transport direction) of the guiding plates 76 is bent and directed toward the guide plate 64.

Inside each of the endless belts 74, there are placed multiple fans 78 for sucking the back side of the sheet member P onto the endless belt 74.

According to the above-mentioned configuration, as the motor 72 rotates the endless belts 74, and operates the fans 78, the belt transport device 60 transports the sheet member P toward the downstream side of the sheet transport direction while sucking the back side of the sheet member P onto the endless belts 74.

[Fixing Device]

The fixing device 62 includes a heat roller 80 and a pressure roller 82. The heat roller 80 includes a heat source in the inside, and rotates when a rotary force is transmitted from a motor (not illustrated). The pressure roller 82 is placed above the heat roller 80. The pressure roller 82 presses the sheet member P against the heat roller 80, and is driven to rotate following the rotation of the heat roller 80.

According to the above-mentioned configuration, the sheet member P is guided by the guide plate 64 to the contact part T (nip part) of the heat roller 80 and the pressure roller 82, and the sheet member P is transported while being nipped by the heat roller 80 and the pressure roller 82 that are rotating. As a result, a toner image transferred to the surface of the sheet member P comes into contact with the heat roller 80 to be thereby heated, thereby fixing the toner image onto the sheet member P.

Figure 5A:
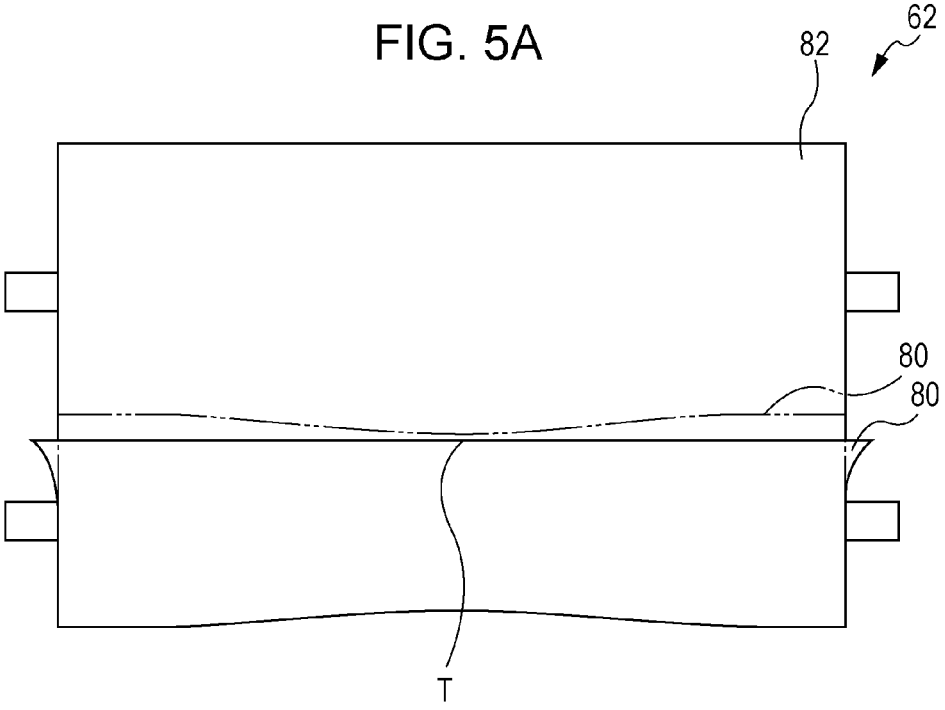
FIGS. 5A and 5B are plan views illustrating how the sheet member is transported by the fixing device provided to the image forming apparatus according to the first exemplary embodiment of the invention.

When the fixing device 62 is viewed from the sheet transport direction, as illustrated in FIG. 5A, in the heat roller 80, either end side of the direction orthogonal to transport projects radially outwards with respect to the center side. In FIG. 5A, the amount of projection is exaggerated for easy recognition of this projection.

Figure 5B:
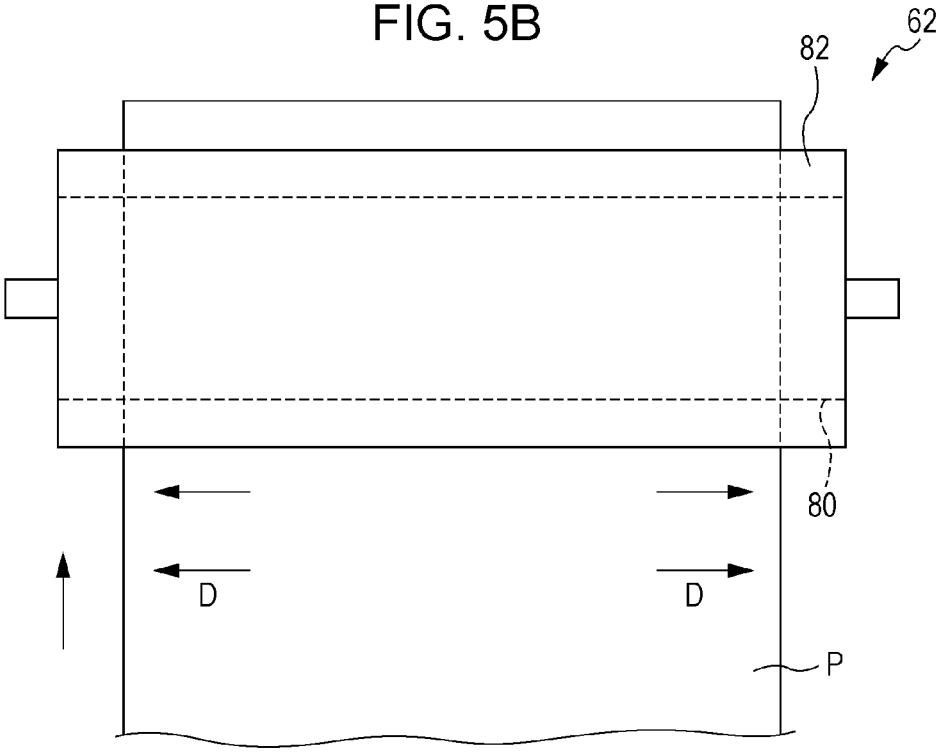

The surface layer of the heat roller 80 is formed of an elastic material. At the contact part T with the pressure roller 82, either end side of the heat roller 80 deforms to the outer side of the direction orthogonal to transport (a solid line in FIG. 5A indicates the state after deformation, and a two-dot chain line in FIG. 5A indicates the state before deformation). As a result, when viewed from the direction orthogonal to the plane of the sheet member P being transported, as illustrated in FIG. 5B, on either end side of the sheet transport direction in the sheet member P nipped between the heat roller 80 and the pressure roller 82, a tension is created which tends to stretch the sheet member P to the outer side of the direction orthogonal to transport (see an arrow D in FIG. 5B).

This tension creates a rising part E on either end side of the direction orthogonal to transport, on the downstream side of the sheet transport direction with respect to the contact part T. In the rising part T, the sheet member P partially rises to the pressure roller 82 side.

Figure 3A:
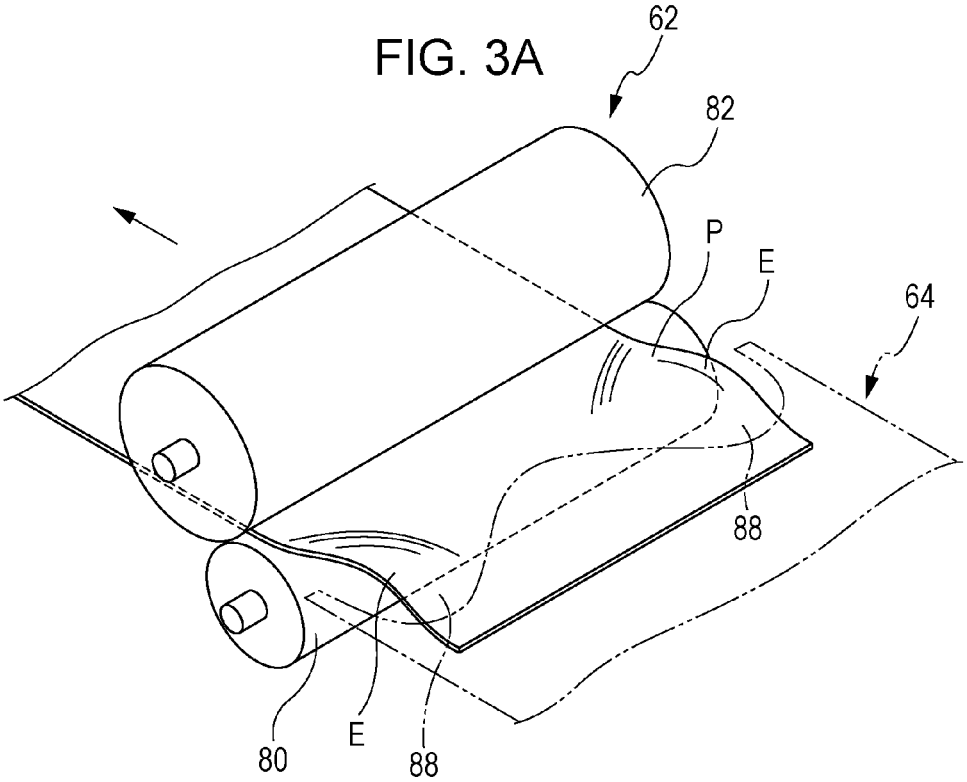
FIGS. 3A and 3B are perspective views illustrating how a sheet member is transported by a fixing device provided to the image forming apparatus according to the first exemplary embodiment of the invention.
Figure 3B:
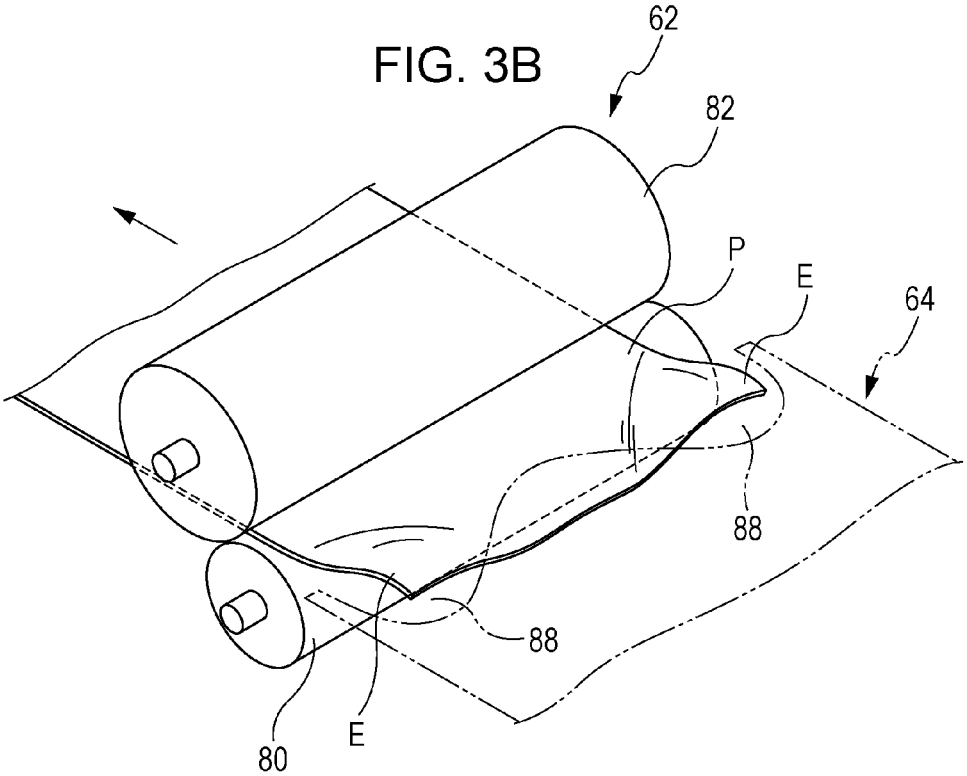

As the sheet member P is transported by the fixing device 62, as illustrated in FIGS. 3A and 3B, the trailing edge of the sheet member P moves toward the rising part E.

[Guide Plate]

Figure 2:
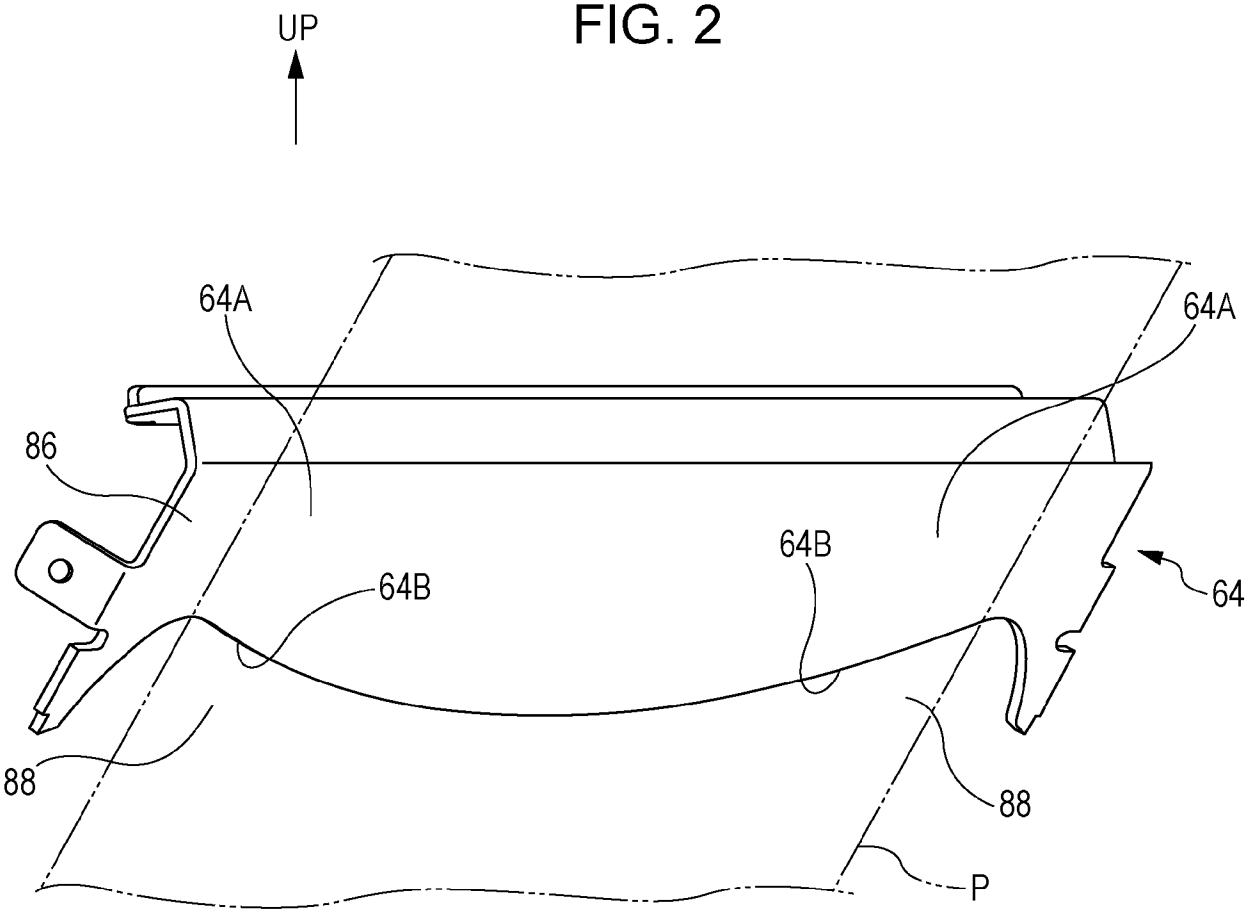
FIG. 2 is a perspective view illustrating a guide plate of the fixing section provided to the image forming apparatus according to the first exemplary embodiment of the invention.

As illustrated in FIGS. 1 and 2, the guide plate 64 is provided with a guide surface 86 that contacts the back side of the sheet member P in order to guide the sheet member P toward the contact part T (see FIG. 6) of the fixing device 62.

Also, on either outer side portion of the direction orthogonal to transport in the guide plate 64 (the outer side of the width direction of the sheet member P), a clearance part 88 is formed on the fixing device 62 side. The clearance part 88 is so shaped as to be located clear of and away from the back side of the sheet member P (away from the transport path 30).

Specifically, the clearance part 88 is formed by cutting the fixing device 62 side of an outer side guide part 64A, which guides the outer side of the direction orthogonal to transport of the sheet member P in the guide plate 64, toward the upstream side of the sheet transport direction. In other words, the clearance part 88 is formed by placing an edge 64B on the fixing device 62 side of the outer side guide part 64A, on the upstream side of the sheet transport direction.

The clearance part 88 is formed so as to become gradually larger in the sheet transport direction, from the center portion of the direction orthogonal to transport (the center portion of the width direction) toward the outer side of the direction orthogonal to transport (the outer side of the width direction) in the guide plate 64. More specifically, at least within the area through which the sheet member P of the largest possible size (see FIG. 2) on which an image can be formed by the image forming apparatus 10 passes, the clearance part 88 is formed so as to become gradually larger toward the outer side of the direction orthogonal to transport.

As a result, in the guide surface 86 that contacts the back side of the sheet member P, the center side of the direction orthogonal to transport is located close to the fixing device 62 in comparison to the outer side. By positioning the center side of the direction orthogonal to transport in the guide surface 86 close to the fixing device 62 in this way, the sheet member P is guided toward the contact part T of the fixing device 62.

As illustrated in FIGS. 3A and 3B, the clearance part 88 mentioned above is formed in the part where the rising part E is created.

(Operation of Configuration of Major Part)

Next, operation of the configuration of the major part will be described.

As illustrated in FIGS. 1 and 6, the sheet member P is transported toward the guide plate 64 with its back side being sucked by the belt transport device 60.

As the surface of the sheet member P transported toward the guide plate 64 comes into contact with the guide surface 86 of the guide plate 64, the sheet member P is transported toward the contact part T of the fixing device 62.

The sheet member P guided toward the contact part T is transported while being nipped between the heat roller 80, which rotates with its internal heat source generating heat, and the pressure roller 82. As a result, a toner image transferred to the surface of the sheet member P is fixed onto the sheet member P.

Figure 4:
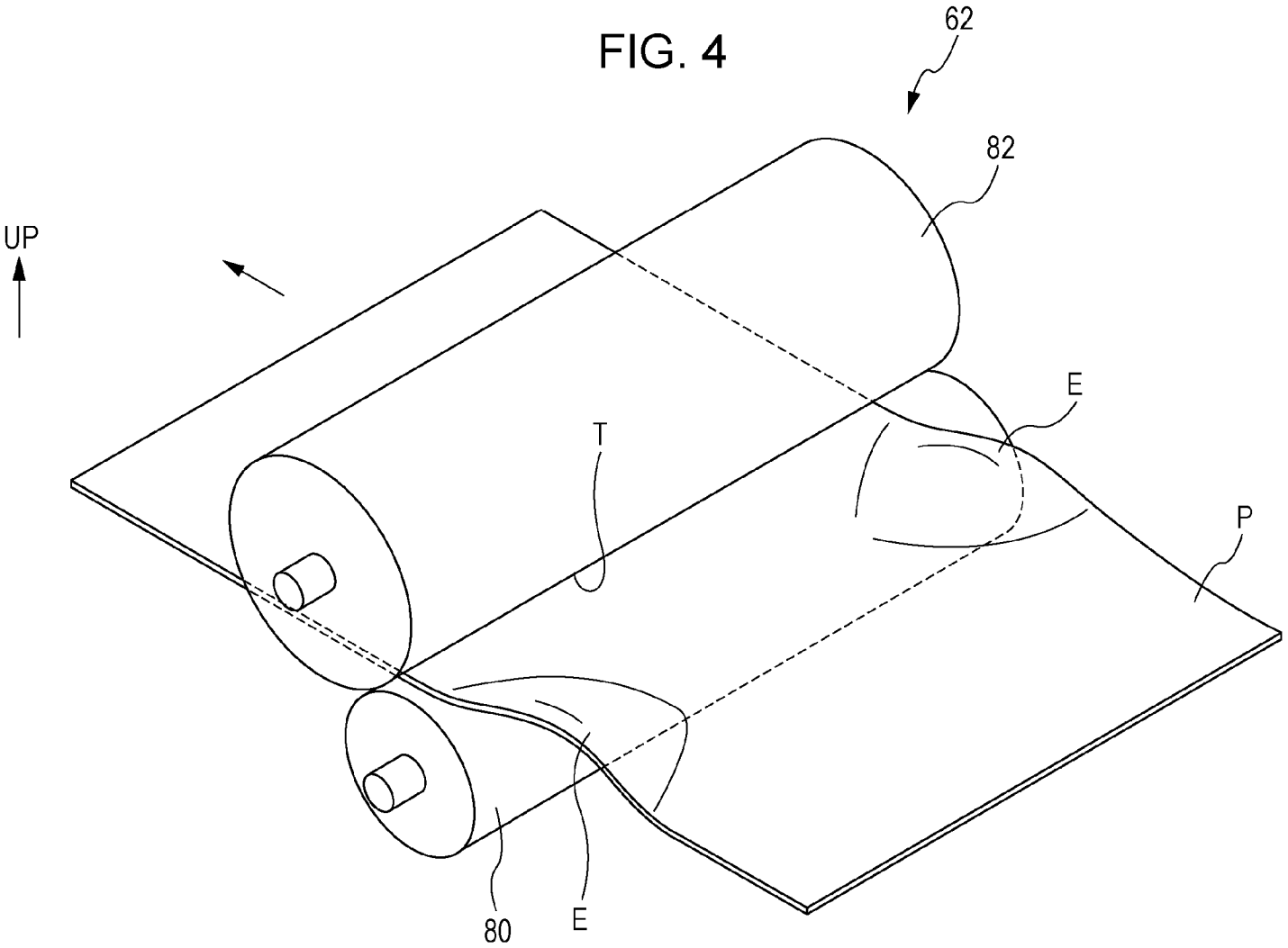
FIG. 4 is a perspective view illustrating how the sheet member is transported by the fixing device provided to the image forming apparatus according to the first exemplary embodiment of the invention.

As described above, on either end side of the direction orthogonal to transport in the sheet member P nipped between the heat roller 80 and the pressure roller 82, a tension is created which causes the sheet member P to be stretched to the outer side of the direction orthogonal to transport (see the arrow D in FIG. 5B). As illustrated in FIG. 4, owing to this tension, the rising part E where the sheet member P partially rises to the pressure roller 82 side is created on either end side of the direction orthogonal to transport, on the downstream side of the sheet transport direction with respect to the contact part T.

As illustrated in FIGS. 3A and 3B, the rising part E of the sheet member P mentioned above is created in the clearance part 88. As a result, the rising part E maintains its shape without being pressed by the guide surface 87.

Further, as the sheet member P is transported by the fixing device 62, the trailing edge of the sheet member P moves toward the rising part E. Then, as the trailing edge of the sheet member P passes through the rising part E, the maintained shape of the rising part E is eliminated.

In this way, the fixing device 62 fixes an unfixed toner image onto the sheet member P, without the unfixed toner image coming into contact with the protection member 66 that is placed below the sheet member P.

Figure 9A:
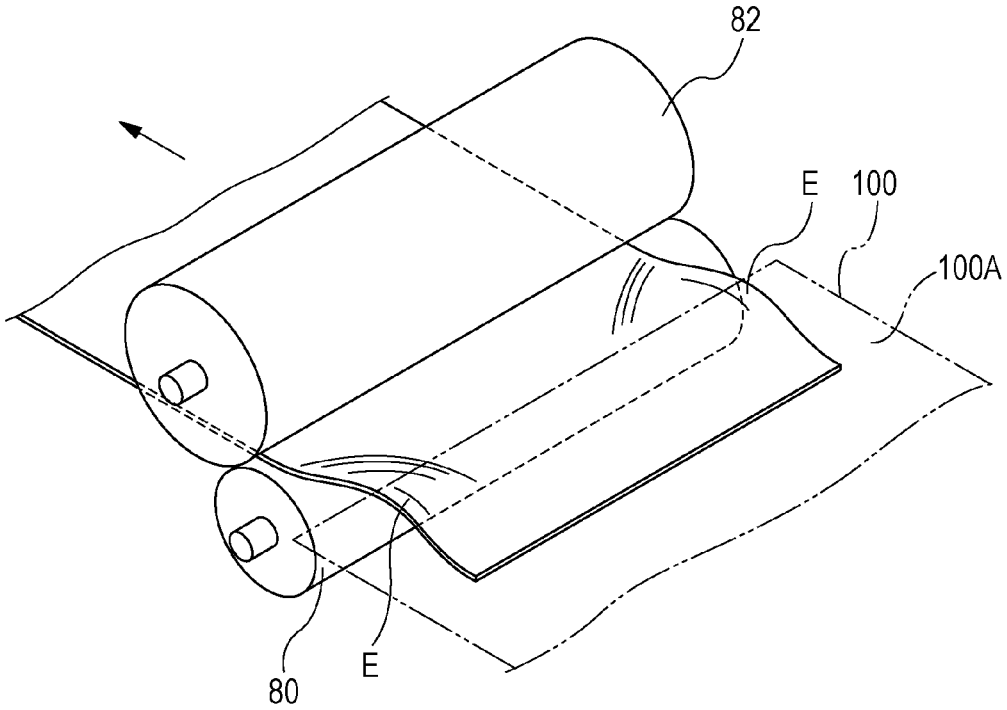
FIGS. 9A and 9B are perspective views illustrating how the sheet member is transported by a fixing device provided to an image forming apparatus according to a comparative example, as opposed to the image forming apparatus according to the first exemplary embodiment of the invention.

Now, as a comparative example with respect to the first exemplary embodiment, a case where no clearance part is formed in a guide plate 100 will be described. In this case, as illustrated in FIG. 9A, the rising part E comes into contact with and is pressed by a guide surface 100A of the guide plate 100.

Figure 9B:
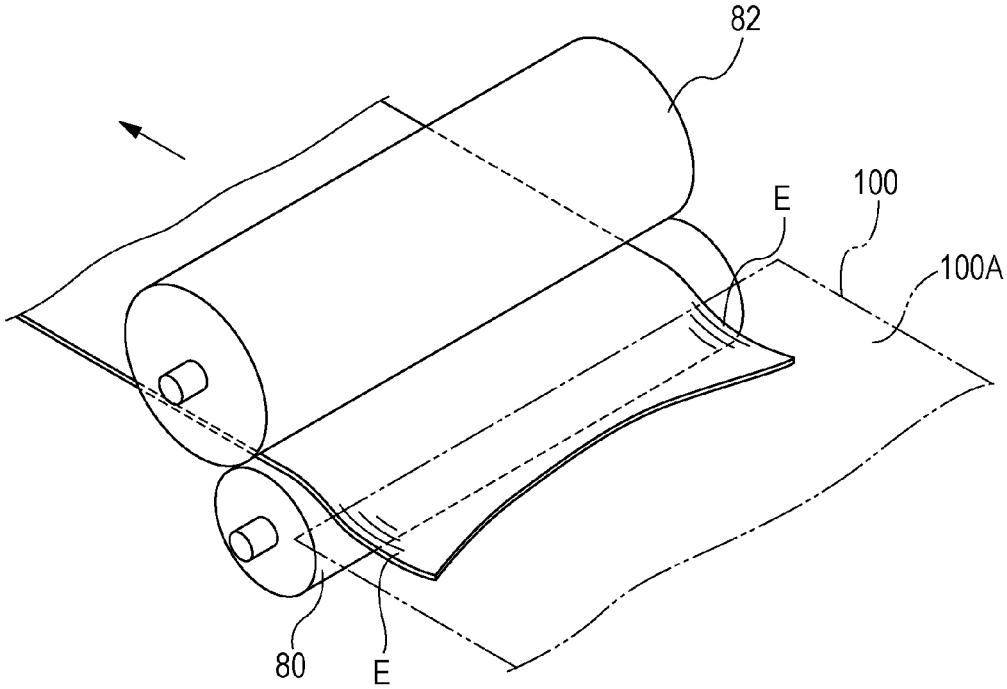

As the trailing edge of the sheet member P approaches the rising part E, as illustrated in FIG. 9B, the rising part E is pressed by the guide surface 100A and reversed. That is, the rising part E is reversed so as to be convex toward the lower side (the heat roller 80 side). As a result, an unfixed toner image formed on the trailing edge side of the sheet member P comes into contact with the protection member 66 (see FIGS. 1 and 6) that protects the heat roller 80, causing damage to the unfixed toner image in some cases (causing so-called smear in some cases).

As described above, the clearance part 88 is formed in the guide plate 64. Therefore, as compared with a case where the clearance part 88 is not formed, this configuration may prevent a decrease in the quality of the output image which occurs when a toner image transferred to the sheet member P comes into contact with a member placed below the sheet member P before being fixed onto the sheet member P.

Moreover, the clearance part 88 is formed on the fixing device 62 side of the guide plate 64. Therefore, as compared with a case where the clearance part 88 is formed on the belt transport device 60 side, this configuration may effectively prevent a decrease in the quality of the output image which occurs when a toner image transferred to the sheet member P comes into contact with a member placed below the sheet member P before being fixed onto the sheet member P.

Moreover, the clearance part 88 is formed by cutting the fixing device 62 side of the outer side guide part 64A in the guide plate 64 toward the upstream side of the sheet transport direction. Therefore, the clearance part 88 may be easily formed as compared with a case where the clearance part 88 is formed by making a part of the guide plate variable.

Moreover, the clearance part 88 is formed so as to become gradually larger in the sheet transport direction from the center side toward the outer side of the direction orthogonal to transport in the guide plate 64. Therefore, as compared with a case where the clearance part is formed partially in the direction orthogonal to transport, a decrease in the quality of an output image may be prevented even when the size of the sheet member P is changed.

Second Exemplary Embodiment

Figure 10:
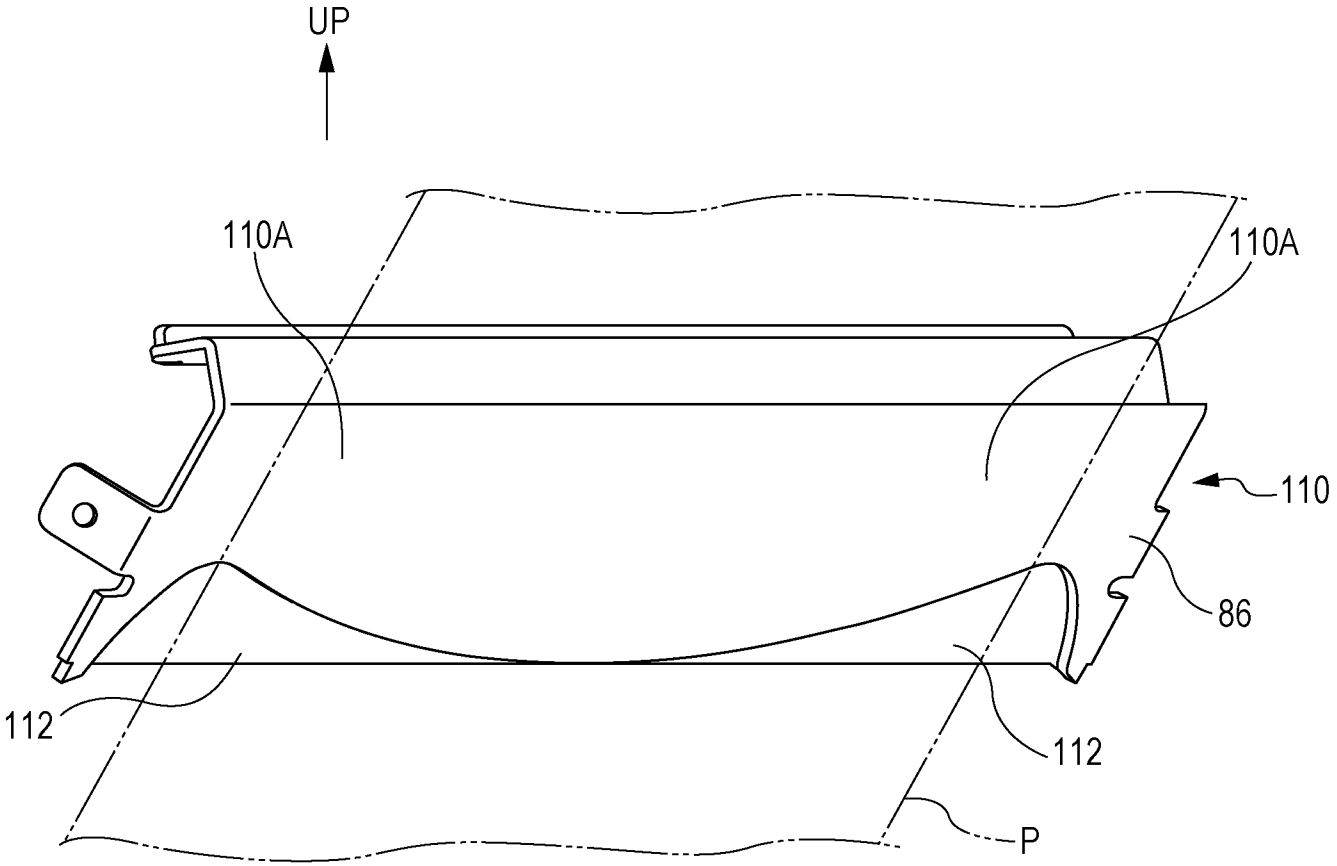
FIG. 10 is a perspective view illustrating a guide plate of a fixing section provided to an image forming apparatus according to a second exemplary embodiment of the invention.

Next, an example of an image forming apparatus according to a second exemplary embodiment of the invention will be described with reference to FIG. 10. The same components as those according to the first exemplary embodiment are denoted by the same symbols and a description of those components is omitted.

A clearance part 112 of a guide plate 110 according to the second exemplary embodiment is not formed by cutting the guide plate 110 toward the upstream side of the sheet transport direction, but is formed by recessing the guide plate 110 away from the back side of the sheet member P. In other words, the clearance part 112 is formed by recessing the fixing device 62 side of an outer side guide part 110A, which guides the outer side of the width direction of the sheet member P in the guide plate 110. The amount of recession (depth) of the clearance part 112 is uniform.

Operation of the second exemplary embodiment is the same as that of the first exemplary embodiment.

Third Exemplary Embodiment

Next, an example of an image forming apparatus according to a third exemplary embodiment of the invention will be described with reference to FIGS. 11 to 12B. The same components as those according to the second exemplary embodiment are denoted by the same symbols and a description of those components is omitted.

Figure 12A:
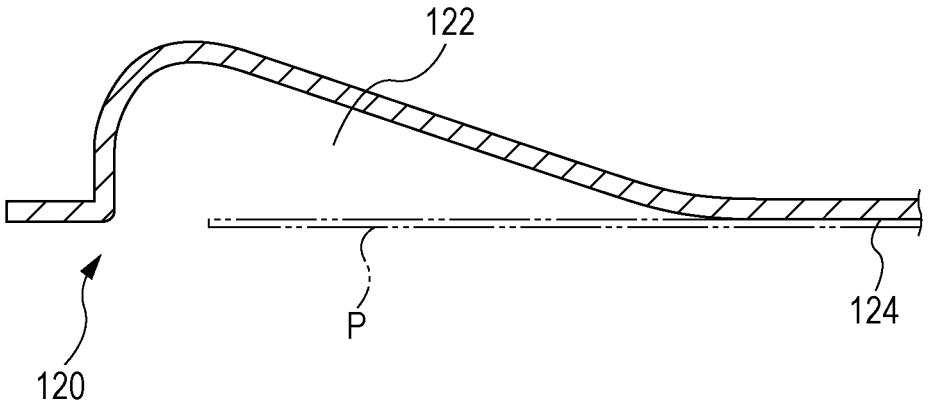
FIGS. 12A and 12B are cross-sectional views illustrating the guide plate of the fixing section provided to the image forming apparatus according to the third exemplary embodiment of the invention.

The amount of recession of a clearance part 122 of a guide plate 122 according to the third exemplary embodiment is not uniform. As illustrated in FIG. 12A, at least within the area through which the sheet member P of the largest possible size on which an image can be formed by the image forming apparatus 10 passes, the amount of recession of the clearance part 122 in the direction orthogonal to transport becomes gradually larger from the center side toward the outer side of the direction orthogonal to transport.

Figure 12B:
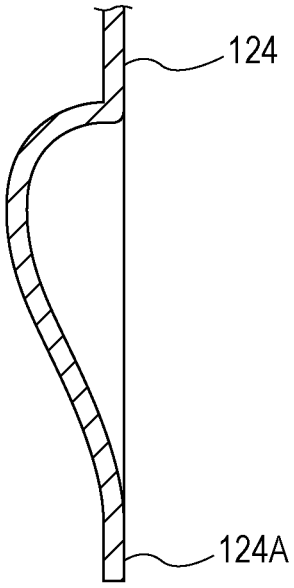

As illustrated in FIG. 12B, the amount of recession in the sheet transport direction becomes gradually larger from the upstream side toward the downstream side of the sheet transport direction.

Figure 11:
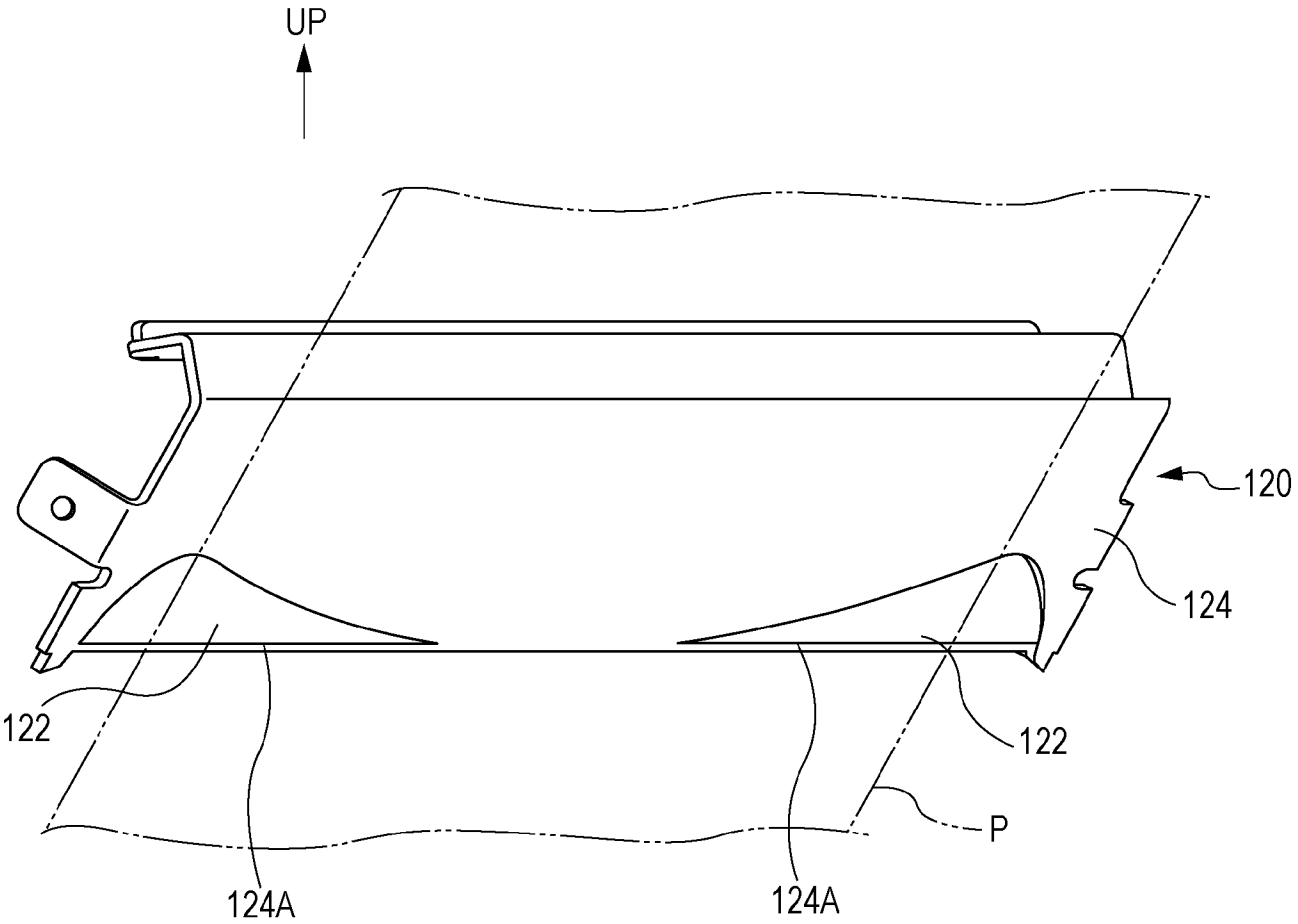
FIG. 11 is a perspective view illustrating a guide plate of a fixing section provided to an image forming apparatus according to a third exemplary embodiment of the invention.

Further, as illustrated in FIG. 11, a guide tip part 124A is formed in a downstream portion of the sheet transport direction with respect to the clearance part 122. The guide tip part 124A constitutes a part of a guide surface 124 that contacts the back side of the sheet member P.

That is, on the fixing device 62 side in the guide plate 120, the guide tip part 124A is formed from one end side to the other end side of the guide plate 120 so as to extend in the direction orthogonal to transport.

In this way, the guide tip part 120A that extends in the direction orthogonal to transport is formed. Therefore, as compared with a case where no guide tip part extending in the direction orthogonal to transport is formed, the sheet member P may be smoothly guided to the contact part T.

Otherwise, operation of the third exemplary embodiment is the same as those of the first and second exemplary embodiments.

While specific exemplary embodiments of the invention have been described above in detail, the invention is not limited to these exemplary embodiments, and it is obvious for those skilled in the art that various other exemplary embodiments are possible within the scope of the invention. For example, while the guide plate 62, 110, 120 in a substantially plate-like shape has been described as an example of a guide member in the above exemplary embodiments, for example, multiple rod members extending in the sheet transport direction may be arranged side by side in the direction orthogonal to transport to serve as a guide member. In this case, a clearance part is formed by changing the length of the rod members.

What is claimed is:

1. An image forming apparatus comprising:

a transfer member configured to transfer a toner image to a surface of a recording medium;

a transport member configured to transport the recording medium, with the surface of the recording medium on which the toner image has been transferred by the transfer member facing down;

a fixing member downstream of the transport member in a transport direction of the recording medium, the fixing member configured to fix the toner image onto the recording medium while nipping and transporting the recording medium;

a protection member configured to protect the fixing member; and a guide member that is placed above the protection member and between the transport member and the fixing member, the guide member configured to contact a back side of the recording medium to guide the recording medium toward the fixing member, the guide member having a clearance part being shaped so as to be clear of the back side of the recording medium and to prevent a rising edge of the recording medium from contacting the protection member.

2. The image forming apparatus according to claim 1, wherein the clearance part is formed on an end of the guide member.

3. The image forming apparatus according to claim 1, wherein:

the guide member has a substantially plate-like shape;

the guide member has an outer side guide part that guides the outermost widthwise portion of the recording medium; and the outer side guide part includes a recess that forms the clearance part.

4. The image forming apparatus according to claim 1, wherein:

the guide member is formed in a substantially plate-like shape;

the guide member has an outer side guide part that guides the outermost widthwise portion of the recording medium; and an edge of the outer side guide part, which is nearest the fixing member, forms the clearance part.

5. The image forming apparatus according to claim 2, wherein:

the guide member has a substantially plate-like shape;

the guide member has an outer side guide part that guides the outermost widthwise portion of the recording medium; and the outer side guide part includes a recess that forms the clearance part.

6. The image forming apparatus according to claim 2, wherein:

the guide member is formed in a substantially plate-like shape;

the guide member has an outer side guide part that guides the outermost widthwise portion of the recording medium; and an edge of the outer side guide part, which is nearest the fixing member, forms the clearance part.

7. The image forming apparatus according to claim 1, wherein a width of the clearance part becomes gradually and continuously larger from a center portion of the clearance part in the transport direction.

8. An image forming apparatus comprising:

a transfer member configured to transfer a toner image to a surface of a recording medium;

a transport member configured to transport the recording medium, with the surface of the recording medium on which the toner image has been transferred by the transfer member facing down;

a fixing member downstream of the transport member in a transport direction of the recording medium, the fixing member configured to fix the toner image onto the recording medium while nipping and transporting the recording medium;

a protection member configured to protect the fixing member; and a guide member that is above the protection member and between the transport member and the fixing member, the guide member contacting a back side of the recording medium to guide the recording medium toward the fixing member, the guide member having a clearance section that clears a back side of the recording medium, the clearance section having a width that becomes gradually and continuously larger in the transport direction of the recording medium over an entire length of the clearance section in the transport direction.

9. The image forming apparatus according to claim 8, wherein the guide member has first and second outer portions that sandwich an inner portion, the clearance part being on the outer portions of the guide member and on an edge of the guide member that faces the fixing member.

10. The image forming apparatus according to claim 9, wherein a distance between the outer portions of the guide member and the transport member is less than a distance between the inner portion of the guide member and the transport member.

11. An image forming apparatus comprising:

a toner transfer member;

a recording medium transport member configured to transfer the recording medium with a transferred toner image facing down;

a fixing member configured to fix toner to a recording medium; and a guide member between the recording medium transport member and the toner fixing member, the guide member including an edge portion having a first width, an inner portion, and a clearance portion having a second width and being sandwiched between the inner portion and the edge portion, wherein the recording medium clears the clearance portion, and the second width is greater than the first width, and wherein the first width of the edge portion extends from an edge of the guide member to the clearance portion in a direction which is perpendicular to a transport direction of the recording medium.

12. The image forming apparatus according to claim 11, wherein the clearance portion prevents an unfixed toner image from contacting a member below the guide member.

* * * * *